US005220140A

United States Patent [19]

Ball et al.

[11] Patent Number: 5,220,140

[45] Date of Patent: Jun. 15, 1993

[54] SUSCEPTORS FOR BROWNING OR CRISPING FOOD IN MICROWAVE OVENS

[75] Inventors: Melville D. Ball; Laurie A. Coady, both of Kingston, Canada

[73] Assignee: Alcan International Limited, Montreal, Canada

[21] Appl. No.: 716,695

[22] Filed: Jun. 17, 1991

[51] Int. Cl.[5] ..... H05B 6/80

[52] U.S. Cl. ..... 219/10.55 F; 219/10.55 M; 219/543; 99/DIG. 14; 156/150; 428/469

[58] Field of Search ..... 219/10.55 F, 543, 540, 219/10.55 E, 10.55 M; 204/38 A, 38 R; 99/DIG. 14; 156/150, 151; 428/469, 629, 632; 430/58, 526

[56] References Cited

U.S. PATENT DOCUMENTS

| | | | |
|---|---|---|---|
| 3,763,004 | 10/1973 | Wainer et al. | 204/38 A |
| 3,805,023 | 4/1974 | Wainer et al. | 219/543 |
| 3,943,039 | 3/1976 | Wittrock | 204/42 |
| 4,267,420 | 5/1981 | Brastad | 219/10.55 E |
| 4,267,422 | 5/1981 | Bell, Jr. et al. | 219/69.13 |
| 4,306,135 | 12/1981 | Bell, Jr. et al. | 219/69.13 |
| 4,369,242 | 1/1983 | Arimilli et al. | 430/58 |
| 4,431,707 | 2/1984 | Burns et al. | 428/629 |
| 4,623,417 | 11/1986 | Spencer et al. | 156/345 |
| 4,641,005 | 2/1987 | Seiferth | 219/10.55 E |
| 4,703,148 | 10/1987 | Mikulski et al. | 219/10.55 E |
| 4,837,061 | 6/1989 | Smits et al. | 428/40 |
| 4,870,233 | 9/1989 | McDonald et al. | 219/10.55 E |
| 4,883,936 | 11/1989 | Maynard et al. | 219/10.55 F |
| 4,945,201 | 7/1990 | Ito et al. | 219/110 |
| 4,985,606 | 1/1991 | Faller | 219/10.55 E |
| 4,985,612 | 1/1991 | Izume et al. | 219/110 |
| 4,994,314 | 2/1991 | Rosenfeld et al. | 428/36.92 |
| 5,015,318 | 5/1991 | Smits et al. | 156/233 |
| 5,055,150 | 10/1991 | Rosenfeld et al. | 156/150 |
| 5,061,837 | 10/1991 | Gilbert et al. | 219/10.55 E |
| 5,062,928 | 11/1991 | Smith | 204/15 |
| 5,071,710 | 12/1991 | Smits et al. | 428/469 |
| 5,098,495 | 3/1992 | Smits et al. | 156/150 |
| 5,112,449 | 5/1992 | Jozefowicz et al. | 205/175 |
| 5,124,172 | 6/1992 | Burrell et al. | 427/2 |
| 5,135,262 | 8/1992 | Smith et al. | 283/94 |
| 5,149,386 | 9/1992 | Smits et al. | 156/150 |
| 5,156,720 | 10/1992 | Rosenfeld et al. | 205/76 |

FOREIGN PATENT DOCUMENTS

| | | |
|---|---|---|
| 0344574 | 12/1989 | European Pat. Off. . |
| 0371739 | 6/1990 | European Pat. Off. . |
| 2186478A | 8/1987 | United Kingdom . |

OTHER PUBLICATIONS

Lentz et al—Microwave World—vol. 9, No. 5, 1988 pp. 11-16.

Wernick et al— "The Surface Treatment & Finishing of Aluminium and Its Alloys"

Castle et al—Food Additives and Contaminants, 1990, vol. 7, No. 6, 779-796.

Begley et al—Food Additives and Contaminants, 1990, vol. 7, No. 6, 797-803.

C. Turpin, "Browning & Crisping" Microwave World, vol. 10, No. 6, 1989 pp. 8-12.

*Primary Examiner*—Bruce A. Reynolds
*Assistant Examiner*—Tu Hoang
*Attorney, Agent, or Firm*—Cooper & Dunham

[57] ABSTRACT

Susceptors used for browning or crisping food prepared in microwave ovens and processes for the production of such susceptors. The susceptors are produced by laminating an anodizable metal (e.g. aluminum, tantalum, niobium, zirconium, titanium or tungsten) onto a suitable non-metallic substrate (e.g a heat resistant polyester film, a paperboard sheet or a glass, plastic or ceramic article) and anodizing the metal layer to form an anodic film covering a residual metal layer of suitable thinness to generate heat by resistance heating when irradiated by microwaves. The anodic film acts as a barrier to prevent the migration of any degradation products to the foodstuff undergoing the heating procedure. The susceptors can be used as wrappings for food items, as package inserts or as internal coatings on food containers and the like.

34 Claims, 3 Drawing Sheets

SUSCEPTORS FOR BROWNING OR CRISPING FOOD IN MICROWAVE OVENS

BACKGROUND OF THE INVENTION

1. Field of the Invention

This invention relates to microwave susceptors used for browning or crisping foodstuffs heated in microwave ovens and to processes for producing such susceptors.

2. Description of the Prior Art

The use of microwave ovens for preparing foodstuffs is widespread these days but a persistent problem is that food items do not "brown" or "crisp" in such ovens in the way that they do when prepared in conventional ovens. For some foodstuffs this does not matter very much, but for others, such as meats, baked goods, pizzas, fish sticks, popcorn and fish fillets, the lack of browning or crisping results in an unappealing food product.

There has been a considerable amount of attention paid to this problem and one solution has been the use of so-called microwave susceptors which are positioned adjacent to the food as it is heated. Microwave susceptors are materials which absorb some of the incident microwave energy and convert it to radiant or convected heat which browns or crisps the outer surface of the food item without affecting the microwave cooking process brought about by the remainder of the microwaves which pass through or around the susceptor.

Susceptors of this kind can be produced by vacuum depositing a thin metal layer onto a heat resistant polymer (e.g. polyester) film. This metallized plastic is then adhesively bonded to a suitable ovenable substrate or backing, such as a paperboard sheet. The metal layer, if thin enough to have sufficient electrical resistivity, is heated by currents generated in the metal by the incident microwave energy. Susceptors can be used as inserts in food packages or as food wrappings that are introduced into the microwave oven with the food items and are removed before the food items are served. Examples of this kind of susceptor are disclosed in U.S. Pat. No. 4,703,148 issued on Oct. 27, 1987 to Mikulski et al; U.S. Pat. No. 4,870,233 issued on Sep. 26, 1989 to McDonald et al; European patent publication 0,344,574 to Peshek et al and European patent publication 0,371,739 to Beckett.

U.S. Pat. No. 4,641,005, issued Feb. 3, 1987, describes microwave susceptor in which a conductive layer is formed as an extremely thin metal film deposited on a substrate protective layer by a process of vacuum vapour deposition. The protective layer is typically polyester and it is designed to be the layer most near to the food.

U.S. Pat. No. 4,267,420, issued May 12, 1981, describes a wrapping material for a food item to be subjected to microwave heating. This wrapping consists of a flexible plastic film having a very thin metal film applied thereto by vacuum vapor deposition.

Recently, the high temperature conditions in which these susceptors are used have been found to cause degradation of the components (such as polymers, adhesives and paperboards) and possibly the susceptor metal layers themselves, and there is a concern that the resulting degradation products may cause health problems if they are allowed to contaminate the food items being prepared. In studies carried out by the Federal Drug Administration of the United States, traces of benzene (a carcinogenic material) and other degradation products have been identified. There is therefore a possibility that the use of the susceptors may be limited by government regulations to temperatures below 300° F. (167° C.). At these temperatures the browning and crisping effects are minimal for most food items.

There is therefore a need for susceptors suitable for the browning and crisping of food that are less susceptible to degradation at elevated temperatures or which are less likely to contaminate food items if degradation does take place.

OBJECTS OF THE PRESENT INVENTION

An object of the present invention is a susceptor material with a unique and novel structure such that the surface in contact with the food is stable and inert over the normal range of operating conditions.

Another object of the present invention is the provision of a microwave susceptor capable of browning or crisping food with limited degradation to harmful products and/or with limited contamination of the food if degradation does take place.

Yet another object of the invention is to provide a process for producing a microwave susceptor of the above kind which can be operated relatively simply and economically.

SUMMARY OF THE INVENTION

According to one aspect of the invention, there is provided a process for producing a susceptor suitable for browning or crisping food, which process comprises supporting a layer of anodizable metal on a non-metallic substrate; and anodizing the metal to produce an anodic film overlying a residual metal layer having a thickness suitable for generating heat when irradiated with microwave energy.

According to another aspect of the invention, there is provided a susceptor suitable for browning or crisping food, which comprises a non-metallic substrate; a layer of metal sufficiently thin to generate heat when irradiated with microwave energy supported on the substrate; and a film, e.g. stable oxide film, overlying the metal layer forming a barrier against migration of products from the substrate.

Although generally not preferred, the microwave susceptor of this invention may be used without a non-metallic substrate.

Figure 1:
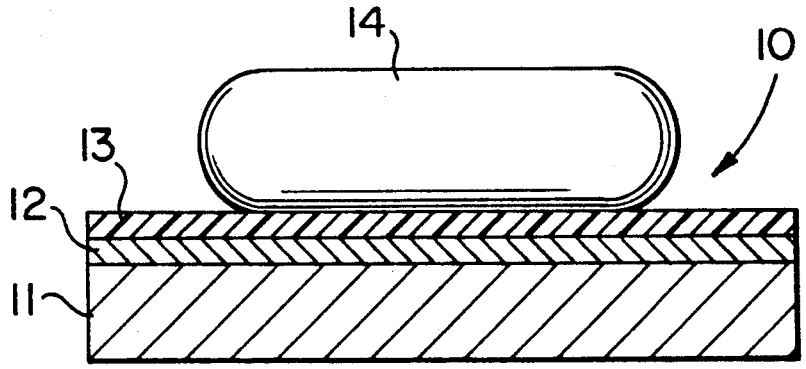
FIG. 1 PRIOR ART
FIG. 1 is a cross-section of a typical prior art susceptor.

In the drawings, no attempt has been made to show the relative thicknesses of the various layers to scale.

Like items are illustrated in the drawings by like or similar reference for the sake of convenience.

DETAILED DESCRIPTION OF THE INVENTION AND THE PREFERRED EMBODIMENTS

In the present invention, a metal layer thin enough to generate sufficient heat for browning or crisping food when subject to irradiation with microwaves (e.g. a metal layer of about 10 μm or less, generally 0.2 μm or less, more preferably 0.02 μm or less and optionally 0.01 μm for aluminum) is preferably supported on a suitable substrate and covered with a continuous layer of an oxide of the metal, normally in the form of an anodic film. The oxide layer forms a barrier of low permeability which, when positioned on the food side of the susceptor, prevents direct contact between the food and the metal, and prevents or minimizes contamination of the food by any products of degradation of the substrate of the susceptor. The oxide layer can form an effective barrier even if it is very thin. For example, layers which have a continuous non-porous region as thin as 100–150 Å may be quite effective. Incidentally, the metal layer also acts as a barrier to contamination by degradation products of the substrate.

The products of the invention are prepared most easily by supporting a thin metal layer on a suitable substrate and then anodizing the outer surface of the metal layer to grow the required protective oxide layer as an anodic film. Porous anodization can be employed if the metal is aluminum or an anodizable aluminum alloy (these are the only useful metals which undergo porous anodization), or non-porous anodization can be employed either for aluminum or for other anodizable food compatible metals such as valve metals (e.g. Ta, Nb, Zr, Ti and W). Porous anodization has the advantage that it permits the use of thicker metal layers prior to the anodization step because there is a much higher limit to the thickness of the anodic films which can be formed and consequently to the amount of metal which is consumed. In the case of non-porous anodization, only a thin anodic film (barrier layer) can be grown before the anodization stops, so the metal layer must initially be thin enough to ensure that the residual metal layer can act as a susceptor. Thus, while metal foils of a few microns in thickness can be laminated to a suitable substrate by means of a suitable adhesive if porous anodization is to be carried out, very thin metal films produced by such techniques as sputtering, chemical vapor deposition (CVD), physical vapour deposition (PVD) and the like, may be required if non-porous anodization is to be employed.

Porous anodization of aluminum or aluminum alloys is a well known technique which involves electrolysing the metal as an anode in an electrolyte containing, for example, sulfuric acid or phosphoric acid, at voltages of a few volts up to 125 volts or so. The anodization initially forms a thin barrier layer of anodic oxide but the acid electrolyte partially dissolves this layer as it is formed and produces pores in the growing film. An imperforate barrier layer always exists, however, immediately adjacent to the metal surface, so the pores do not extend completely to the metal and are plugged at their innermost ends by the oxide barrier layer. The resulting porous anodic film thus acts as a barrier to prevent direct contact between the food item, or juices derived therefrom, and the residual metal layer and to prevent contact between any decomposition products which may be produced by degradation of the substrate, adhesives, etc. and the food item.

In the case of aluminum, the residual metal layer can act as a susceptor when it has a thickness of about 50 nm or less, so the porous anodization is carried out until the residual metal layer has a thickness in this range. In fact, the anodization is usually carried out to so-called "consumption", i.e. until the electrolytic current falls to a very low value. This takes place when the residual metal film has become so thin that it exhibits a high electrical resistivity rather than when the metal has been totally consumed as the term may imply. It is precisely a film which has high electrical resistivity that is required as a susceptor layer in the susceptor structure, so a suitable product can be produced by consumption anodization without precise control of the anodization time or rate. However, it is found that the anodization conditions, such as the temperature, current density, voltage, nature of the electrolyte, etc., do have some effect on the final thickness of the residual metal layer, so these conditions may be varied to produce susceptors having the desired heat generation ability for particular applications.

In order to avoid the need for a prolonged porous anodization step in those cases where relatively thick metal foils are used (since anodizing is a relatively expensive procedure), the foil may first undergo a thickness reduction step, e.g. a demetallizing procedure involving uniform etching of the aluminum surface with a caustic material such as sodium hydroxide to reduce the metal thickness. Alternatively, an aluminum metallized substrate having a thin aluminum layer formed, for example by sputtering, may be employed. In this case, the metallized layer has to be continuous and thick enough to allow sufficient anodization to take place in order to form an anodic film capable of acting as a barrier while leaving a suitable residual metal thickness to act as a susceptor. Aids to anodizing, such as flash layers (about 100 Angstroms thick) of Nb, Ta, Ti, Zr, W, Mo or V beneath the aluminum may also be employed to serve as a base for the sputtered Al layer and possibly to act as the metallic component of the susceptor. The flash metallized layers are generally required because, if Al is sputtered directly onto a substrate such as a polymer, the anodic film formed during anodizing may not be uniform and the resulting adhesion is often poor.

Non-porous anodization is similar to porous anodization except that electrolytes which do not readily dissolve the oxide film are used and, for this application, only thin starting metal layers may be used. Prior to the non-porous anodization step, the anodizable metal is deposited onto a suitable substrate by techniques of the type mentioned above to a suitable thickness generally in the range of 300–5000 Å, and more preferably in the range of 500–2000 Å for reasons of economy and ease of processing. Non-porous anodization is typically carried out by ramping the voltage up to a preselected value, which is less than the breakdown voltage of the system of interest, for the anodizing conditions used. On reaching this peak voltage, the current falls to a low value and film growth stops. The resulting barrier layer thickness is directly proportional to the anodizing voltage, with thicker films being formed at higher voltages. For aluminum oxide, the use of voltages of up to about 300 volts is not uncommon to produce anodic films having thicknesses up to about 0.4 μm.

As indicated above, prior to the anodization of either the porous or non-porous kind, the metal layer is generally supported on a suitable supporting substrate, although in some cases this may not be necessary if unsupported foil structures are required. The substrate may be any suitable food-compatible heat-resistant material of any suitable shape or thickness provided that the substrate is also resistant to attack or degradation by electrolyte. The choice of substrate depends to some extent on the intended use of the product, e.g. whether it is to be used as a packaging material, an insert for a food package, or a reusable container, etc.

A particularly suitable substrate for the preparation of a packaging film or food package insert is a heat resistant polyester sheet, e.g. of the type sold under the trademark MYLAR. While such polymer sheets used in susceptors have been subject to heat degradation in the past, when they are used in products according to the present invention, even if some degradation does take place, the degradation products do not appear to permeate the metallised layer and the anodic film layer.

Susceptors incorporating polymer films may, if desired, be laminated onto other backing layers, such as layers of ovenable paperboard, in order to provide additional support or stiffness. In such cases, an exposed polymer surface is generally adhered or otherwise attached to the backing layer leaving the anodic film exposed.

As alternatives to the use of polyester films as the initial substrate for the residual metal layer, other non-metal substrates such as paper, paperboard, glass, plastic or ceramic may be used, provided the materials have suitable heat resistance and resistance to attack or degradation by electrolyte if anodizing is to be carried out following substrate attachment. When glass, plastic, ceramic or other stiff durable non-metallic material is used, the susceptor may form part of a reusable container or utensil, such as a dish, bowl or container lid, suitable for heating foodstuffs sold in other packages. In such cases, the anodic film and residual metal layer form the inner surface of the container.

If desired, sheet-like susceptors according to the present invention may comprise substrates having anodic films and residual metal layers formed on both sides. In this way, degradation products from the substrates are confined to the interior of the susceptor structure and either side of the structure may be positioned adjacent to the food item. A two-sided structure of this kind may also be laminated directly onto an ovenable paperboard or the like for extra support or stiffness. A porous anodic film on the side of the susceptor attached to the paperboard backing or other additional backing advantageously assists the adhesion of the susceptor to the backing since the adhesive soaks into the pores and thus becomes firmly anchored to the anodic film.

The susceptors of the present invention can be modified to overcome a further disadvantage of prior art susceptors, namely that the food item is often browned or crisped unevenly by the susceptor. It often turns out that the edges of the food item are well browned or crisped but the centre remains cooler and moist. This can be overcome by patterning the susceptor so that the thin heat-generating metal layer is present in certain areas of the susceptor but absent from other areas. Such patterned susceptors are particularly easy to produce according to the present invention because certain areas of the metal layer can be covered by a mask prior to the anodization treatment so that the covered areas do not undergo anodization. After the anodization step, the mask can be removed and the areas of metal directly beneath it either subjected to a short anodization step to produce a thin barrier oxide film, or left as they are. The thicker metal film in the areas previously covered by the mask either does not generate heat during the microwave heating step or generates less heat, so these areas of the susceptor can be positioned adjacent to the areas of the food item which brown or crisp most easily. Alternatively, certain areas of the metal layer may be masked and the remaining exposed areas subjected to demetallization with caustic alkali. The mask may then be removed, and the remaining metal areas subjected to porous or non-porous anodization in the stated manner to produce a patterned susceptor film which can be used in the same way.

Having discussed the invention in general terms above, specific embodiments of the susceptors of the invention and a prior art structure for comparison are shown in the accompanying drawings and are described below.

FIG. 1 shows a typical prior art susceptor 10. The susceptor has a metal layer 12 thin enough to act as a heat generator supported on a backing 11 made of ovenable paperboard. A heat-resistant polymer layer 13, generally made of polyester, overlies the metal layer 12 and separates the metal layer from a food item 14 to be heated. During heating, degradation of the polymer layer 13 takes place and the degradation products then contact the food item 14. Moreover, the polymer layer 13 crazes or cracks during heating, thus permitting degradation products from lower layers to contact the food item 14, or juices emanating therefrom to contact the metal layer 12 directly. Crazing or cracking of the polymer layer will also cause crazing and cracking of the metallized layer since they are intimately attached. Consequently, the adhesive and paperboard (or other supporting layer) are exposed and can interact with the food.

Figure 2:
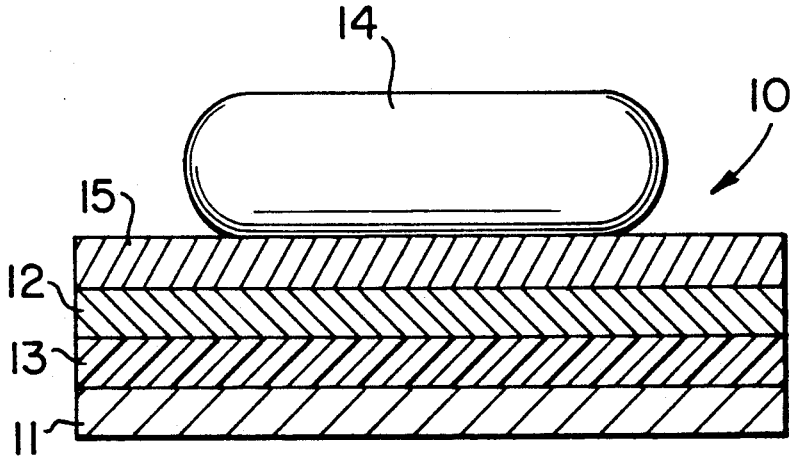
FIG. 2 is a cross-section similar to FIG. 1 of a preferred susceptor according to the present invention.

FIG. 2 is a cross-section similar to FIG. 1 showing a preferred susceptor structure according to the present invention. The susceptor 10 has a metal layer 12 supported on a heat resistant polyester film 13 acting as a substrate and is overlaid by an anodic oxide film 15. The indicated structure is then supported by a backing layer 11 made, for example, of ovenable paperboard. The oxide film 15 is inert and heat stable and is thus harmless to the food item 14. The oxide also acts as a barrier to prevent degradation products from lower layers from contacting the food item 14. The oxide film 15 also provides support to the metal layer 12 and the polymer film 13 during the heating step to help prevent shrinking and cracking of the polymer during heating. The backing layer 11 also helps to support the film.

The structure shown in FIG. 2 may be modified in various ways (not shown), provided the resulting modified structures have a metal layer 12 thin enough to act as a microwave susceptor preferably supported by a suitable substrate on one side and covered by an oxide film on the other side, usually the side intended to contact the food item 14. For example, the backing layer 11 may be omitted to produce a more flexible susceptor useful, for example, as a packaging film for food items. Alternatively, the backing layer 11 and the polymer film 13 may be replaced by a thicker heat resistant substrate made of glass, plastic, or ceramic etc. and shaped, for example, to form a container or other utensil. Furthermore, sheet-like susceptors having susceptor layers and protective anodic films on both sides of a supporting substrate may be produced, if desired.

Figure 3:
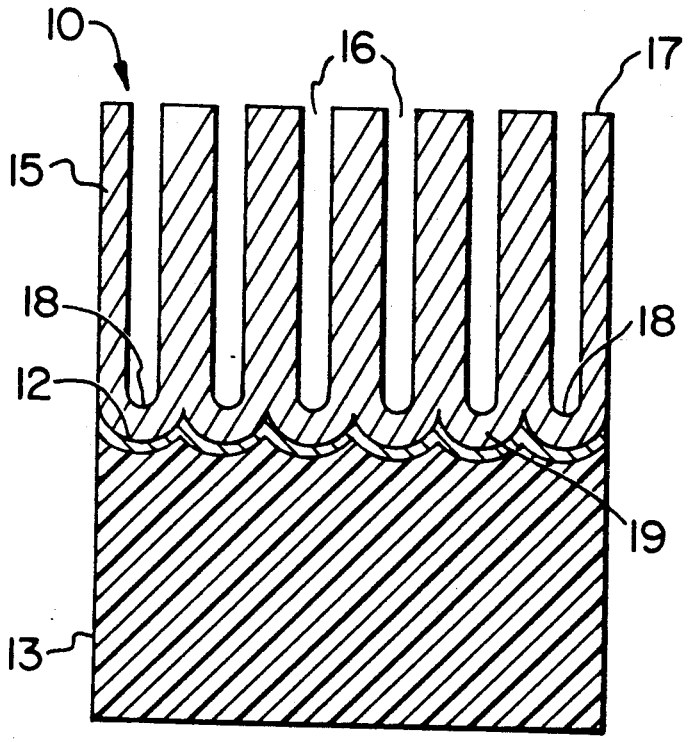
FIG. 3 is an enlarged schematic cross-section of a susceptor according to another preferred form of the invention.

FIG. 3 is a representational cross-section on an enlarged scale of a susceptor similar to that of FIG. 2 but having no backing layer 11. In this case, the anodic film 15 has been formed by porous anodization. Pores 16 extend inwardly from an outer surface 17 of the film towards a thin residual metal layer 12. The inner ends 18 of the pores are closed by a dense continuous barrier oxide film 19 which isolates the residual metal layer 12 from the surface 17.

Figure 4:
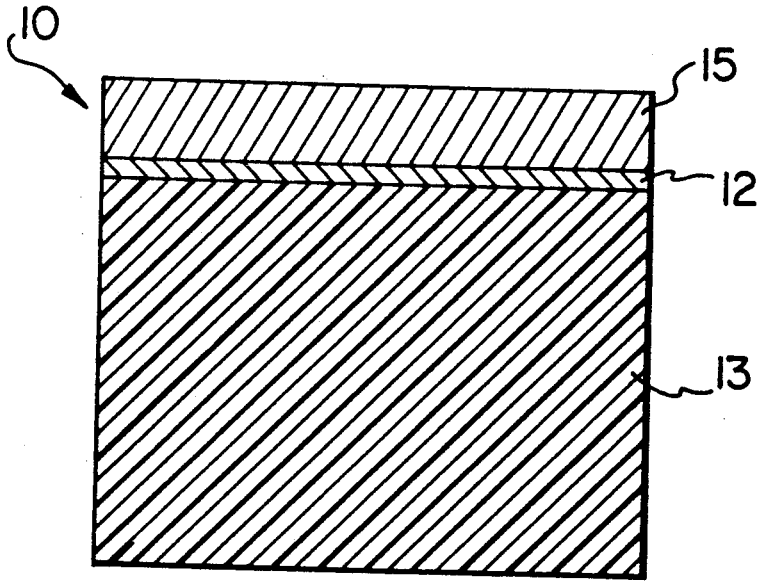
FIG. 4 is an enlarged schematic cross-section of a susceptor according to yet another preferred form of the invention.

FIG. 4 is a cross-section similar to FIG. 3 of a susceptor according to another form of the invention in which the anodic film 15 has been produced by a non-porous anodization technique. In this case, a thin barrier oxide film 15 is formed over the entire surface of a residual metal layer 12 (e.g. made of Al, Ta, Nb, Zr, Ti or W), supported by a polyester substrate film 13.

Figure 5:
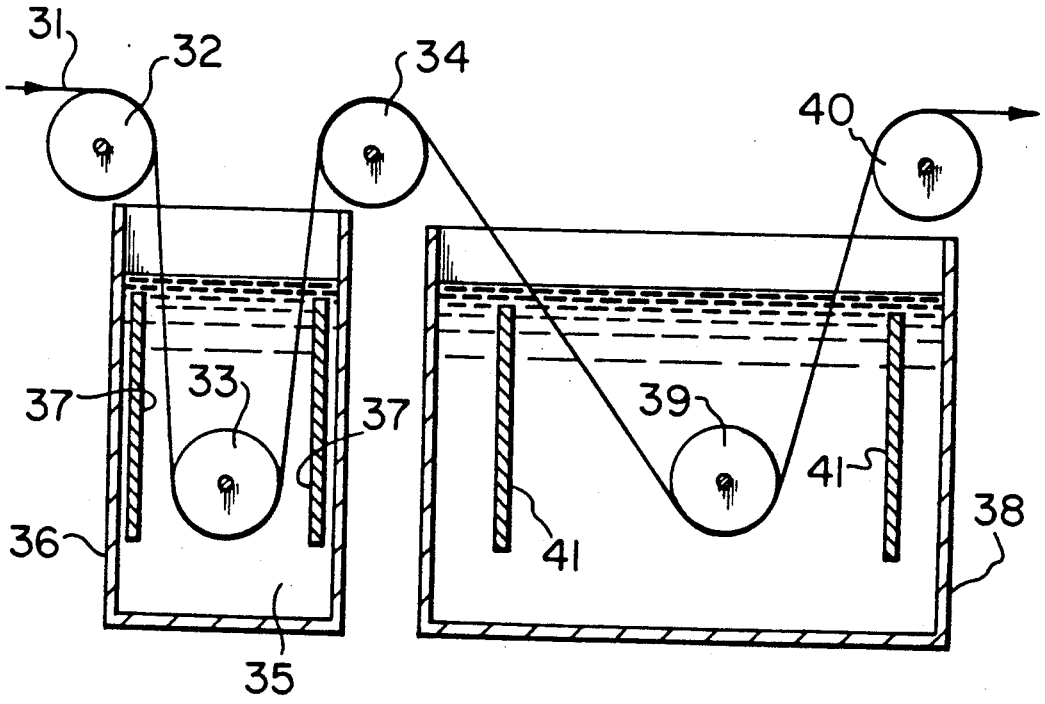
FIG. 5 is a cross-section of a preferred apparatus for producing a susceptor according to the present invention on a continuous basis.

The process of the present invention can be operated continuously, if desired, for example using liquid contact cells as shown in FIG. 5. In the illustrated process, a web 31 consisting of an anodizable metal foil attached to a polyester film is first conveyed from a roll (not shown) over rollers 32, 33 and 34 through an electrolyte 35 of a first contact cell 36 and then via rolls 39 and 40 through a second cell 38. In first cell 36, the web 31 passes between anodes 37 and thus becomes cathodic and cathodic reactions occur and hydrogen is generated. The current travels along the length of the metal layer of the web until it enters the second cell 38 between cathodes 41 and becomes anodic. Normal anodization takes place in the second cell. The hydrogen evolved at the metal surface in the first cell 36 is very effective in removing contaminants from the metal surface and thus cleans the metal surface before anodization takes place in the second cell 38. The resulting electrolysis of the web causes an anodic film to form on the metal while leaving a residual metal layer capable of acting as a susceptor layer. After leaving the anodizing cell 38, the resulting susceptor is washed and collected on a suitable roll (not shown).

In continuous processes of this kind, careful attention must be paid to maintain a constant concentration of electrolyte, a constant temperature and a constant throughput of the foil. In general, a system for agitating and circulating the electrolyte (not shown) should be provided. More details of liquid contact cells of this kind can be obtained from a textbook entitled "The Surface Treatment and Finishing of Aluminum and its Alloys" by Wernick, Pinner and Sheasby, 5th edition, Vol. I & Ii, Finishing Publications Ltd., 1987, p. 493–496, Vol. I, the disclosure of which is incorporated herein by reference.

The invention is illustrated in more detail by the following non-limiting Examples.

EXAMPLE 1

Aluminum foil having a thickness of 12 microns was laminated to a heat resistant polyester film also having a thickness of 12 microns by roller coating the foil with an adhesive approved for use with food, laminating it to the polyester film while the adhesive was still tacky and curing the adhesive at elevated temperature. The laminated film was anodized in 165 g/l sulphuric acid at 23° C. and 15 V to consumption, i.e. until there was insufficient metal remaining to support the anodizing process. The anodized film was then placed on paperboard and a slice of bread was placed on top. After microwaving at high for about 30 seconds, the bread was removed and the side in contact with the anodic film was found to be toasted.

In order to test the reproducibility of the film, a second sample was similarly prepared, but in this case it was laminated to the paperboard using an epoxy adhesive. Nine slices of bread were then toasted in the microwave oven, with no apparent significant degradation of the film or decrease in its effectiveness.

EXAMPLE 2

Various samples of niobium sputtered glass were barrier anodized in 50 g/l citric acid at various voltages, resulting in residual metal layers of different thicknesses adjacent to the glass and separated from the food by an inert oxide. The metal layers were in the range of about 260–360 Å in thickness. These samples also toasted bread quite easily in the microwave oven.

EXAMPLE 3

Aluminum foil having a thickness of 12 microns was laminated to a heat resistant polyester film also having a thickness of 12 microns using an FDA approved adhesive and complying with the recommended curing procedure. For preliminary experiments, small coupons (100 $cm^2$) were anodized in a small tank of 165 g/l sulphuric acid at 23° C. and 15 V until the current dropped to a low value indicating that most of the metal had been consumed. The anodizing was stopped at 26.5 min. and at 48.5 min. during this current decrease stage, and samples with different metal thicknesses in each case were obtained. Care was taken to eliminate "edge effects" during anodizing by applying an acid resistant lacquer around the edges of the coupon.

Electric field absorption coefficients for these samples were then determined based on measurements in a wr-284 waveguide at 2.45 GHz. In this waveguide, the amount of microwave signal transmitted and reflected by the sample can be measured, and from this data, the amount absorbed by the sample can be determined. The absorption coefficient, defined as: (electric field absorbed/incident electric field)$\times$100%, is indicative of the efficiency of the susceptor, i.e., the higher the number, the greater the amount of microwave energy converted to thermal energy. The absorption coefficients were found as follows:

| Absorption Coefficient (%) | Anodizing Time (Min.) |
|---|---|
| 35 | 26.5 |
| 50 | 48.5 |

For comparison, the absorption coefficient for commercial susceptor material was similarly measured at 33%.

Anodic film susceptors with absorption coefficients similar to commercial susceptors (around 30%), were then tested by laminating them to paperboard and placing slices of bread on top. Typically, the side of the bread in contact with the anodic film was found to be toasted after microwaving at high power for approximately 30 seconds. This compares very favourably with commercial susceptor performance.

What we claim is:

1. A process for producing a susceptor suitable for browning or crisping food, which comprises:

anodizing a surface of a layer of an anodizable metal to form an anodic film on said surface and to produce a residual metal layer of reduced thickness of less than 10 μm, said reduced thickness of said residual metal layer being suitable for generation of heat in said residual metal layer when said residual metal layer is irradiated with microwave energy.

2. A process for producing a susceptor suitable for browning or crisping food, which process comprises:

supporting a layer of anodizable metal on a non-metallic substrate; and anodizing a surface of said metal to form an anodic film on said surface and to produce a residual metal layer of reduced thickness of less than 10 μm, said reduced thickness of said residual metal layer being suitable for generation of heat in said residual metal layer when said residual metal layer is irradiated with microwave energy.

3. A process according to claim 2 wherein said metal is selected from the group consisting of aluminum and anodizable aluminum alloys.

4. A process according to claim 3 wherein said anodizing is carried out in an electrolyte which causes porous anodization to take place.

5. A process according to claim 2 wherein said anodizing is carried out in an electrolyte which causes non-porous anodization to take place.

6. A process according to claim 2 wherein said metal is selected from the group consisting of aluminum, tantalum, niobium, zirconium, titanium, tungsten and anodizable alloys thereof.

7. A process according to claim 2 wherein said non-metallic substrate is a heat resistant polyester film.

8. A process according to claim 2 wherein said non-metallic substrate is selected from the group consisting of paper, ovenable paperboard, glass, plastic and ceramic.

9. A process according to claim 2 wherein said anodizing step is carried out until said residual metal layer has a thickness of less than 0.2 μm.

10. A process according to claim 2 wherein said anodizing step is carried out until said residual metal layer has a thickness less than 0.02 μm.

11. A process according to claim 2 wherein said layer of anodizable metal is supported on said substrate by adhering said layer to said substrate.

12. A process according to claim 11 wherein said layer is reduced in thickness by a chemical procedure before said anodizing in order to reduce the duration of said anodizing.

13. A process according to claim 2 wherein said layer of anodizable metal is supported on said substrate by a method selected from the group consisting of sputtering, chemical vapour deposition and physical vapour deposition.

14. A process according to claim 13 wherein a metal selected from niobium, tantalum, titanium, zirconium, molybdenum, vanadium and tungsten is deposited as a thin layer on said substrate prior to supporting said layer of anodizable metal.

15. A process according to claim 13 wherein said anodizable metal layer is formed at a thickness of 300–5000 Å.

16. A process according to claim 6 wherein said anodization is carried out at a voltage up to about 300 V to produce an anodic film having a thickness up to 0.4 μm.

17. A process according to claim 2 wherein said substrate is generally planar and has opposed surfaces and which comprises applying a layer of said anodizable metal to both said opposed surfaces and anodizing both said metal layers to produce said residual metal layers and anodic films on both said surfaces.

18. A process according to claim 2 wherein said substrate is attached to a backing material.

19. A process according to claim 18 wherein said backing material is ovenable paperboard.

20. A process according to claim 2 wherein said anodizable metal is subjected to anodization over limited areas of said substrate to produce a susceptor having limited areas capable of generating heat when irradiated with microwaves and other areas incapable of generating heat.

21. A process according to claim 2 carried out continuously by supporting said metal on a flexible substrate and passing said supported metal layer from a supply roll through an electrolyte between cathodes, said metal being connected as an anode, and collecting said anodized supported layer on a collection roll.

22. A susceptor suitable for browning or crisping food, which comprises:

a layer of metal having a thickness of less than 10 μm capable of generating heat when irradiated with microwave energy; and an oxide film overlying said metal layer forming a barrier against migration of decomposition products from said metal layer.

23. A susceptor according to claim 22 further comprising a non-metallic substrate supporting said metal layer.

24. A susceptor according to claim 22 wherein said metal is selected from the group consisting of aluminum and anodizable aluminum alloys.

25. A susceptor according to claim 24 wherein said film is a porous anodic film.

26. A susceptor according to claim 22 wherein said metal is selected from the group consisting of aluminum, tantalum, niobium, zirconium, titanium, tungsten and anodizable alloys thereof.

27. A susceptor according to claim 26 wherein said anodic film is a non-porous anodic film.

28. A susceptor according to claim 23 wherein said non-metallic substrate is heat-resistant polyester film.

29. A susceptor according to claim 23 wherein said non-metallic substrate is selected from the group consisting of paper, ovenable paperboard, glass, plastic or ceramic.

30. A susceptor according to claim 22 wherein said metal layer has a thickness of less than 0.5 μm.

31. A susceptor according to claim 23 wherein said substrate is generally planar and has opposed sides and wherein said layer of metal and said oxide film are present on both sides of said substrate.

32. A susceptor according to claim 23 wherein said substrate is attached to a backing material.

33. A susceptor according to claim 32 wherein said backing material is ovenable paperboard.

34. A susceptor according to claim 23 wherein said layer of metal and said oxide film are present only on limited areas of said substrate as a consequence of which said susceptor generates heat in said areas but not in others when irradiated with microwaves.

* * * * *